US007665608B2

(12) United States Patent
Buckley

(10) Patent No.: US 7,665,608 B2
(45) Date of Patent: Feb. 23, 2010

(54) DISPLAY PACKAGE

(75) Inventor: Nick Buckley, Watford (GB)

(73) Assignee: Bro-Drene Hartmann A/S (DK)

( * ) Notice: Subject to any disclaimer, the term of this patent is extended or adjusted under 35 U.S.C. 154(b) by 363 days.

(21) Appl. No.: 10/511,201

(22) PCT Filed: Dec. 20, 2002

(86) PCT No.: PCT/DK02/00891

§ 371 (c)(1),
(2), (4) Date: Jul. 22, 2005

(87) PCT Pub. No.: WO03/086905

PCT Pub. Date: Oct. 23, 2003

(65) Prior Publication Data

US 2005/0274642 A1 Dec. 15, 2005

(30) Foreign Application Priority Data

Apr. 17, 2002 (EP) ..... 02008640

(51) Int. Cl.
*B65D 85/32* (2006.01)

(52) U.S. Cl. ..... 206/521.1

(58) Field of Classification Search ... 206/521.1–521.9; 220/508; D9/757

See application file for complete search history.

(56) References Cited

U.S. PATENT DOCUMENTS

| | | | | |
|---|---|---|---|---|
| 2,978,162 | A * | 4/1961 | Lambert | 206/521.1 |
| 3,259,294 | A * | 7/1966 | Hartmann | 206/521.1 |
| 3,362,605 | A * | 1/1968 | Bixler | 206/521.1 |
| 3,471,078 | A * | 10/1969 | Seest et al. | 206/521.8 |
| 3,813,027 | A | 5/1974 | Misdom, Jr. et al. | |
| 4,742,952 | A * | 5/1988 | Bixler et al. | 206/521.1 |
| 5,857,574 | A | 1/1999 | Weber | |
| 6,488,152 | B1 | 12/2002 | Steffann | |

FOREIGN PATENT DOCUMENTS

| | | |
|---|---|---|
| DE | 195 30 156 | 2/1997 |
| EP | 0 698 565 | 2/1996 |
| EP | 0 972 724 | 1/2000 |
| FR | 2.086.938 | 12/1971 |
| FR | 2.133.279 | 11/1972 |
| FR | 2 731 986 | 9/1996 |
| GB | 329846 | 5/1930 |
| LU | 79834 | 2/1979 |

* cited by examiner

*Primary Examiner*—Luan K Bui
(74) *Attorney, Agent, or Firm*—Stites & Harbison PLLC; Marvin Petry; Stephen J. Weyer

(57) ABSTRACT

The invention relates to a display and distribution packaging unit for fragile articles, especially for eggs, comprising a bottom part (2) which at least partially matches the outer contours of the articles housed within the unit and a cover part (3) comprising planar top- and side surfaces (10, 14, 15) for the provision of graphical information about the contents of the unit, where portions of the cover part (8) are furthermore shaped to reflect the shape of the eggs housed within the display and distribution package. The structure of the bottom and cover parts furthermore adds mechanical strength to the unit.

37 Claims, 10 Drawing Sheets

Fig. 3a
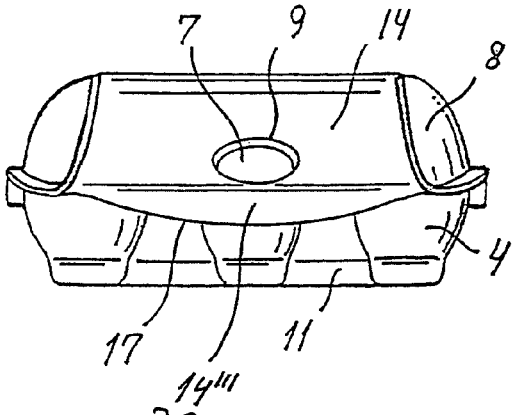
Fig. 3b
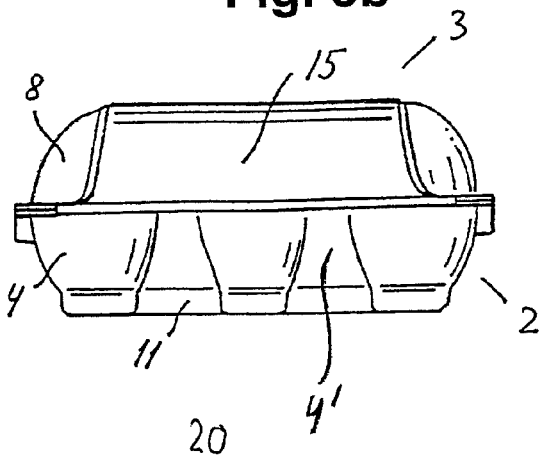
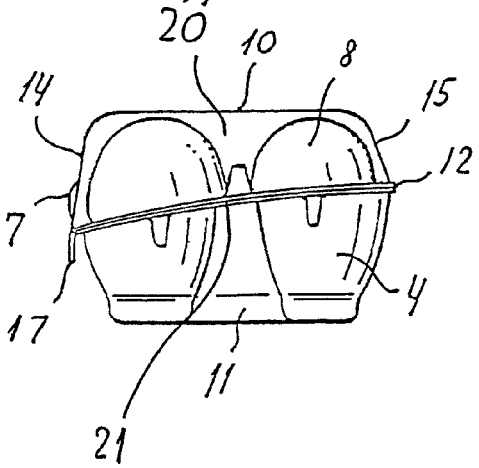
Fig. 3c
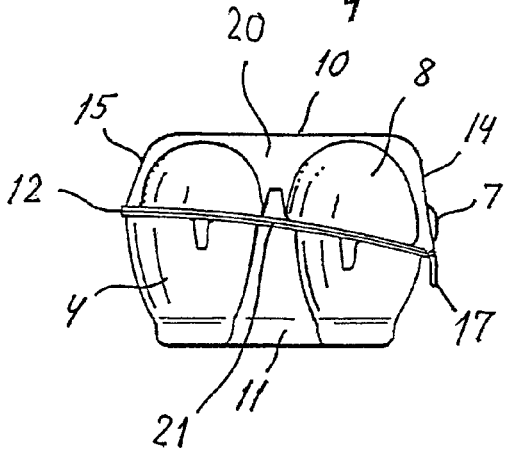
Fig. 3d 15
8
10
7
14

8
14
10
9
7
17
11
4

15
4
20
14
11

DISPLAY PACKAGE

TECHNICAL FIELD

The present invention relates to a display and distribution packaging unit for eggs or similar fragile articles.

DESCRIPTION OF PRIOR ART

Packages for packing and transporting fragile articles such as eggs are known in a variety of forms. Traditionally, such packages have comprised a bottom part provided with suitably shaped compartments for accommodation of the particular article, for instance eggs, and an upper part forming a cover over the bottom part for accommodating the upper portions of the articles housed within the package and for closing the package. Often, the upper part is connected to the lower part by means of a suitable hinge portion, although packages comprising separate bottom and upper parts have also been used. In those packages that comprise a hingedly connected bottom and cover part, the vertical front side of the bottom part is often provided with a flexible flap comprising a number of protrusions for engagement with correspondingly located and shaped holes in the cover part, thereby locking the bottom and cover parts together in the closed state of the package. A package of this kind suffers from various disadvantages. In the closed position, the front face of the package will be subdivided into an upper part and a lower part and as the lower part is typically formed to be able to accommodate and support the articles contained within the package, it is only the upper part which can be given a planar shape that permits the application of text and pictures describing the contents of the package. In use in a store, such packages will often be stacked in a sales rack, and hence it is only the vertical front side, which is visible to the customer. Furthermore, the presence of said holes in the cover part also reduces the possibility to use this face for written and pictorial information. It has furthermore been found that the opening of such packages is often troublesome, as it requires the user to press said protrusions into the holes to disengage the protrusions and the corresponding holes from each other.

A package for eggs of the type comprising a hingedly connected bottom and cover part is disclosed in WO 00/03936. In order to solve the problem of providing a sufficiently large, planar front face for the application of graphical material, the front surface of the cover part extends completely down to the lowermost portion of the bottom part, so that it can rest on the surface supporting the package. Hence, a large unbroken front surface is provided and the extension of the front surface to the supporting surface furthermore adds stability to the package and is beneficial during the moulding process of the package.

Apart from providing large unbroken surfaces for the application of various graphical descriptions of the content of the package, the information about the content of the package can also as an alternative or supplementarily be conveyed by the shape of the package or various parts hereof. A package of this type is the subject of EP 0 698565, which discloses a package comprising a separate packaging unit embracing the articles in an accommodating and supporting manner and where the outer shape of the packaging unit reflects the shape of the eggs contained within the unit. This package is typically provided with a number, for instance six, of egg-shaped compartments and the package is furthermore provided with a display panel comprising suitably sized openings corresponding to the pattern of compartments of the packaging unit, such that the display panel can be placed on top of the compartments in such a manner that the compartments can protrude at least partly through said openings. This package thus comprises two separate parts, i.e. the packaging unit as such and the display panel, which may under circumstances be regarded as a disadvantage from a handling point of view.

DISCLOSURE OF THE INVENTION

It is the object of the present invention to provide a package unit for eggs or similar fragile articles, which in spite of the package unit being made of an opaque material, preferably moulded pulp, due to its form provides a clear, visible information about the contents of the unit and at the same time offers good opportunities for providing graphical and/or pictorial information on large surfaces of the unit.

It is a further object of the present invention to provide a packaging unit which is more easy to open and close compared to traditional packages of the type described initially comprising a hingedly connected bottom and cover part.

It is a further object of the invention to provide a packaging unit which is at least partly of a mechanically strong shell structure that protects the article contained herein, supports these articles over a large surface of these and generally adds mechanical stability to the package.

It is a further object of the invention to provide a packaging unit which can be produced as one integrated unit for instance by suction moulding.

These and other objects and advantages are attained with a packaging unit according to claim 1. Various advantageous embodiments are defined in the dependent claims. p The packaging unit according to the present invention thus comprises a bottom part provided with one or more compartments for accommodating and supporting the eggs in the packaging unit and a cover part, where one or more portions of the cover part are partial ovoid-shaped such that they reflect the shape of the eggs contained within the packaging unit, thereby making the shape of the eggs contained within the unit visible from outside. By shaping portions of the cover part in this manner the contents of the packaging unit becomes more apparent than in prior art packaging units, not only when the packaging unit is seen from the side -- where both the bottom part and the cover part can be seen -- but also when seen from above, in which case the bottom part may be more or less invisible to the viewer.

According to the invention, said cover part and said bottom part can be moulded as one integrated unit by suction moulding.

It should be noted that throughout this description and the appended claims the expression: a portion reflecting the shape of the eggs should be understood as a portion having an ovoid shape that provides a viewer with a clear association of the form of an egg without necessarily having a form exactly corresponding to an egg. Thus, surfaces or subsurfaces of a number of different solids of revolution, for instance of an ellipsoid, may reflect the shape of an egg within this context.

Providing not only the cover part with portions reflecting the shape of the eggs in the unit but also shaping the corresponding portions of the bottom part as partial ovoids such that they reflect the shape of the eggs further enhances the visual information about the content of the unit. The individual portions of the cover part and the corresponding portions of the bottom part may in the closed state of the unit merge into a substantially continuous surface reflecting a relatively large portion of the surface of an egg.

According to the invention, the partial ovoid portions of the cover part reflecting the shape of the eggs and the corresponding portions of the bottom part form compartments for the eggs in the unit, the internal surface of which compartments may also be shaped in a manner corresponding to the egg-shape. Thus, at least some of these compartments embrace and support the eggs over a surface area of up to at least approximately 60% of the total surface area of an egg. The eggs are thus supported in a manner which reduces the risk of damages of the eggs caused by the accelerations experienced for instance during vibrations of the unit and if the unit is accidentally dropped. Specifically said compartments can also be formed to support the eggs at the bottom portion of the compartments.

A further enhancement of the information about the contents of the packaging unit provided by the portions of the cover part reflecting the shape of the eggs within the packaging unit can according to the invention be obtained by providing a clear subdivision of the cover part into those portions reflecting the shape of the eggs and the remaining portions of the cover part. According to the specific embodiments of the invention described in detail in the following, the portions reflecting the shape of the eggs are thus formed as egg-shaped continuous surfaces covering approximately a quarter of the total surface of an egg, whereas the remaining portion of the cover part—designed with the aim of providing large substantially planar areas for the application of various kinds of graphical and/or pictorial information—resembles a box comprising a substantially planar top surface, a front surface, a rear surface and substantially planar end surfaces. The egg-shaped portions are according to this embodiment of the invention located on either end surface of the cover part, thereby yielding a visually clear division between the substantially planar end surfaces and the smoothly curved egg-shaped portions. A placement of the egg-shaped portions on only one of said end surfaces would of cause also be possible.

As an alternative embodiment, it would furthermore be possible to place the egg-shaped portions on one or more of the remaining surfaces of the cover part, thereby further highlighting the contents of the packaging unit.

According to a further embodiment of the invention, the display and distribution packaging unit is characterised in that said cover part on the portion hereof, which is formed to reflect the shape of the eggs in the package, has a different surface structure from remaining portions of the cover part. For instance the portion reflecting the shape of the eggs may have a relatively coarse surface texture, whereas those portions upon which graphical information is to be provided, for instance using adhesive labels, could have a more smooth texture or vice versa. By providing those portions of the cover part, which reflect the content of the unit, with a surface structure differing from the surface structure of the remaining portions of the cover part, the content of the packaging unit is made even more apparent as seen from outside, for instance for a customer in a store.

According to a further embodiment of the invention, the display and distribution packaging unit is characterised in that the interface between said cover part and said bottom part inclines downwardly from the rear side of the package to the front side of the package, thus yielding a higher front side of the cover part than rear side of the cover part, the higher front side thereby providing more space for the attachment of labels, etc. On opening the cover part of the filled packaging unit a larger part of the eggs contained in the unit thus becomes visible from the front side of the unit, which is normally the side of the unit facing the customer in a store. This provides for a better opportunity to inspect the eggs in the unit, for instance for possible damages hereof and has the further effect that the eggs in the unit appear larger.

In order to provide a better grip of the edge portion of the cover part for opening the unit—and also in order to further increase the area of the front surface of the cover part and hence the possibility to attach labels etc. to this portion of the cover part—the lower edge of the front surface may according to the invention be extended in a downwards direction past the interface between the cover part and the bottom part.

According to the invention, said bottom and cover parts are hingedly connected to each other along one edge hereof, the opposite upper edge of the bottom part being provided with a flexible flap comprising at least one outwardly extending protrusion for engagement with a corresponding opening in the cover part.

According to one embodiment of the invention, said one or more protrusion has/have a cross-section in a plane parallel with the front surface of the unit, which substantially corresponds to a longitudinal cross-section through an egg. The protrusions preferably have an overall size sufficiently large to facilitate depression of the protrusion on opening the unit and the outer surface of the protrusions—which can for instance be plane—can either be flush with the outer surface of the corresponding portion of the cover part or extend outwardly beyond this surface over the entire circumference of the protrusion or part hereof.

According to a preferred embodiment of the invention, said protrusions and corresponding openings are shaped to form a tight engagement between the protrusion and the corresponding opening around the entire circumference of the protrusion, but shapes of openings and corresponding protrusions only providing engagement over a portion of the circumference of the protrusion may also be used.

As apparent from the above, large portions of the substantially planar surfaces of the cover part of the packaging unit according to the invention can be provided with graphical and/or pictorial information. Thus, it is even possible to apply such information to the outer surface of the protrusions. Graphical and/or pictorial information may generally be provided in the form of labels or alternatively embossing may provide a three-dimensional surface. This alternative could for instance by used on the outer surface of the protrusions.

According to the invention, the external bottom surface of the bottom part of the unit is provided with a pattern of supporting ribs formed between the base portions of the compartments. Both the curved wall portions of the compartments and the pattern of supporting ribs provide increased mechanical stability of the packaging unit. Furthermore, the supporting ribs and the base portions define a common, plane bottom surface for placement of the packaging unit, thus for instance yielding a more stable placement of units, when these are placed on top of each other. To attain this, it is important that the bottom surface defined by the base portions of the compartments and the supporting ribs define a plane surface and not a surface, which is slightly downwardly curved towards the central portion of the surface. As an alternative embodiment, the central portions of this pattern of bases of compartments and supporting ribs could be located slightly above the plane defined by the peripheral portions of the bases and supporting ribs.

BRIEF DESCRIPTION OF THE DRAWINGS

The invention will now be described in more detail with reference to the accompanying drawings, in which

FIGS. 3*a*-3*d* show one embodiment of the packaging unit according to the invention, in which FIG. 3*a* is a front elevational view; FIG. 3*b* is a back elevational view; FIG. 3*c* is one side view; and FIG. 3*d* is the other side view;

FIGS. 4*a*-4*c* show another embodiment of the packaging unit according to the invention, in which FIG. 4*a* is a top view; FIG. 4*b* is a front elevational view; and FIG. 4*c* is a side elevational view;

FIGS. 5*a*-5*e* show another embodiment of the packaging unit according to the invention, in which FIG. 5*a* is a top view; FIG. 5*b* is a bottom view: FIG. 5*c* is a front elevational view; FIG. 5*d* is a rear elevational view; and FIG. 5*e* is a side elevational view;

FIG. 6*c* is a side elevational view;

DETAILED DESCRIPTION OF THE INVENTION

In the following, the packaging unit according to the invention is described in detail by means of various non-limiting examples of its practical design.

Figure 1:
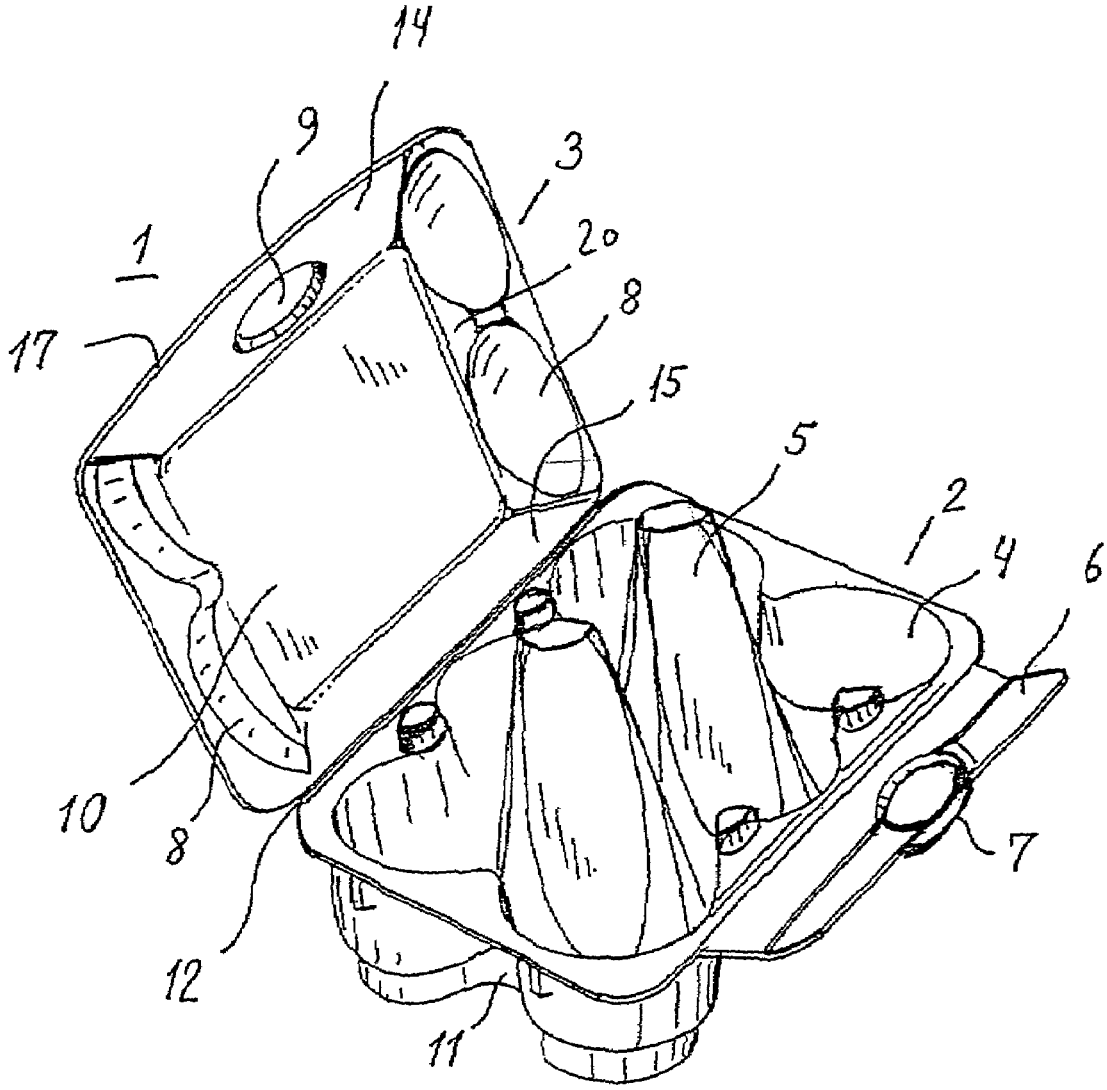
FIG. 1 is a schematical perspective view of one embodiment of a packaging unit according to the invention.

With reference to FIG. 1, there is shown a display and distribution packaging unit according to the invention generally designated by 1 formed to accommodate six eggs. The unit comprises a bottom part 2 and a cover part 3 connected to each other along one edge by means of a flexible connection 12, in the following generally referred to as a hinge permanently attaching the cover part 3 to the bottom part 2. Portions 8 of the cover part 3 are partially ovoid, reflecting the shape of the eggs contained within the unit. The complete unit can be formed as one integrated unit made of moulded pulp.

The bottom part shown in FIG. 1 is subdivided into six compartments 4 by appropriately shaping the wall sections of the bottom part and by inclusion of a pair of upwardly extending pillar posts 5 along the centre line of the bottom part. The shape of the side wall forming part of the compartments 4 is partially ovoid, corresponding to the shape of the eggs contained in the compartments, thereby providing a good support for the eggs and visual information about the content of the packaging unit.

Placed along one upper edge portion of the bottom part 2, there is provided a flexible flap 6, on the outer surface of which there is provided an outwardly extending protrusion 7. In the embodiment shown in FIG. 1, only one protrusion 7 is present, but it is understood that more than one protrusion could be provided if desirable.

Figure 8:
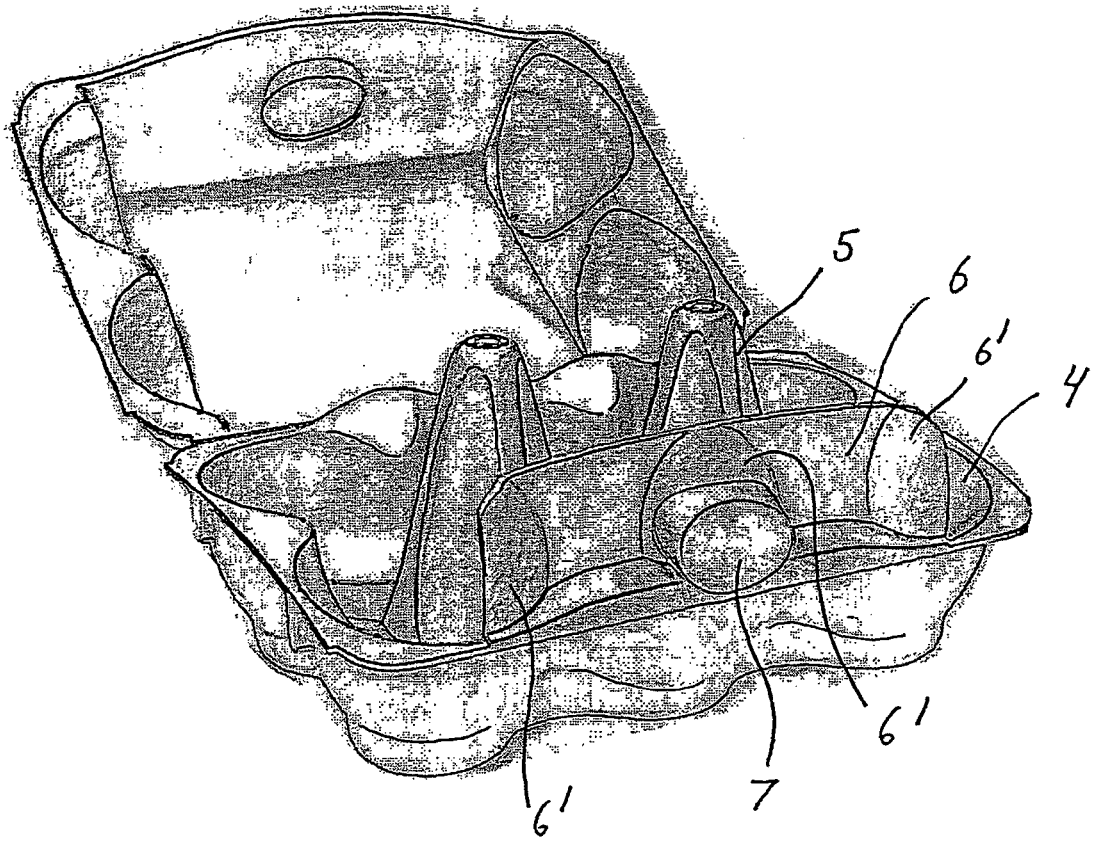
FIG. 8 shows an embodiment of the packaging unit according to the invention in an open state.
Figure 9:
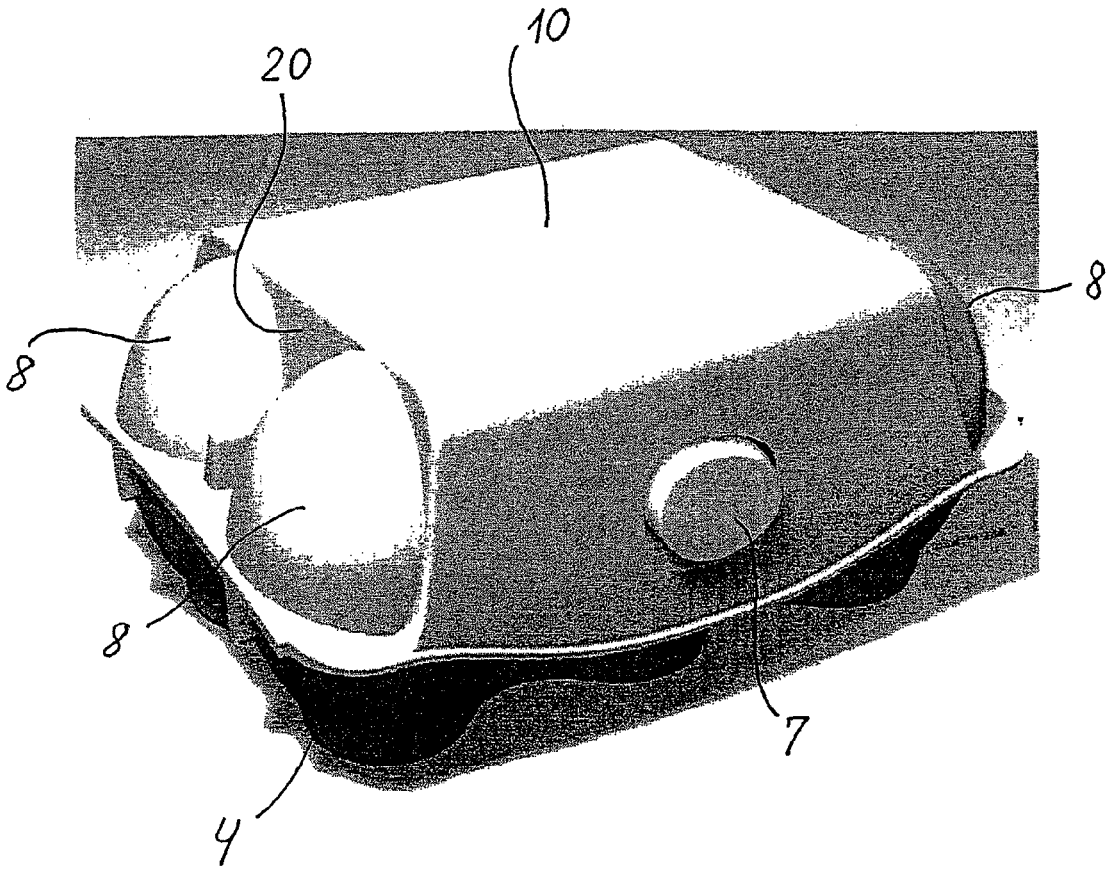
FIG. 9 shows the embodiment of FIG. 8 in the closed state.

According to one embodiment of the invention, portions 6' of the flap 6 may be formed in such a manner that they constitute a part of the walls of the adjacent compartments of the unit. This embodiment is shown in detail in FIG. 8.

The cover part 3 according to the embodiment shown in FIG. 1 comprises essentially two different portions, i.e. a central portion, the shape of which to some extent resembles the shape of a box and comprising a substantially planar top face 10, substantially planar front and rear faces 14, 15 and substantially planar end faces 20 (see for instance FIGS. 3*a*-3*d*, 4*a*-4*c*, 5*a*-5*e*, 6*a*-6*c*, 7). The front face is provided with an aperture 9, the position, shape and size of which corresponds to the protrusion 7 on the flexible flap 6 of the bottom part 2. The front face 14 being flexible makes it possible to close the cover part 3, whereby the protrusion 7 will be brought into engagement with the aperture 9. Pulling along the edge portion of the front face 14, it is possible to bring the protrusion 7 out of engagement with the aperture 9, whereupon the packaging unit can be opened.

The combination of the downwardly curved shape of the front face 14—as indicated by 17 in the Figures—and the relatively large protrusions make it easy for the user to open the unit. Furthermore, the protrusions are styled to suggest the contents of the unit, i.e. they are approximately egg-shaped. If desired, the outer substantially planar face of the protrusion may even be provided with text or pictures, such as the text: "press to open" or the like. As mentioned above, instead of providing the planar face of the protrusions with a label, embossing may provide a three-dimensional surface hereof.

Regarding the size of the protrusions, at least one pertinent requirement would be that the planar face hereof should be of a size facilitating the opening of the unit, as this would normally take place during use. The size of the planar face should based on this requirement not be less than that of an average fingertip of a thumb, which would amount to approximately 2 cm in the vertical direction of the protrusion and somewhat larger in the longitudinal direction of the protrusion, in order to preserve the egg-shape of the planar face. Typical dimensions would be within the range (20 mm to 30 mm)×(15 mm to 20 mm), typically approximately 16 mm×24 mm, although other dimensions may of course also be employed. For aesthetical reasons it may also be desirable to make the choice of the size of the protrusions dependent on the other dimensions of the unit, particularly on the dimension of the planar front surface 14 of the cover part.

The second portion of the cover part 3 comprises the egg-shaped compartment walls 8 located at either longitudinal end of the cover part 3. These compartment walls 8 provide additional support for the eggs contained within these compartments and reflects the shape of the eggs thereby providing a visual indication of the content of the packaging unit. To highlight the visual information—and provide a pleasing aesthetic effect—it is possible to provide the compartment walls 8 with a different surface texture than the planar surfaces 10, 14, 15 and 20, where the first three of these surfaces for instance can be used for the placement of labels etc. As mentioned in the disclosure of the invention, the contrast between the curved portions 8 and the substantially planar end faces 20 and the distinct line of division between these contribute to highlight the information about the contents of the packaging unit.

Figure 2A:
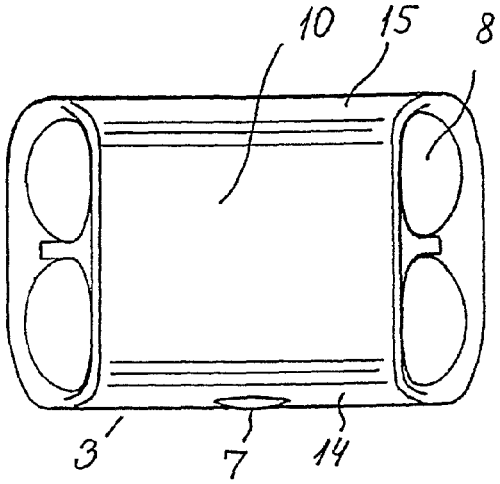
FIG. 2*a* is a top view and FIG. 2*b* is a bottom view of the above embodiment of a packaging unit according to the invention.
Figure 2B:
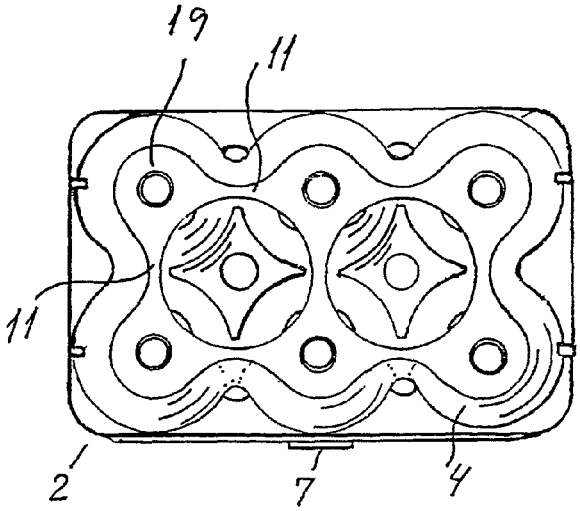
Figure 4A:
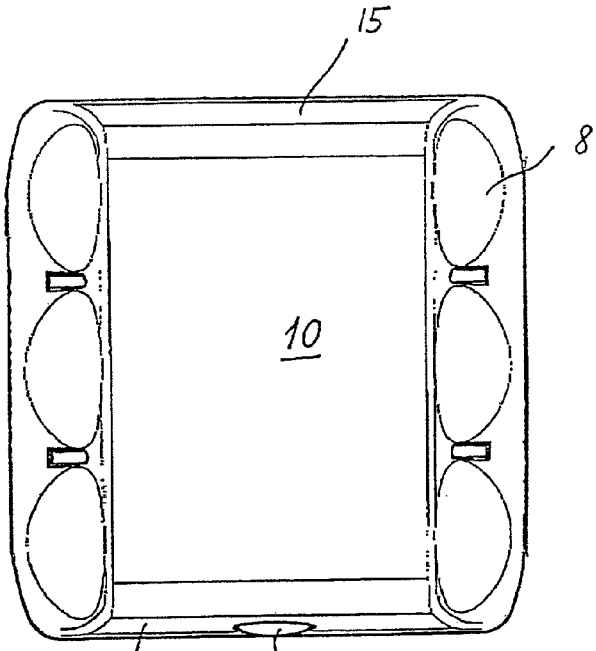
Figure 4B:
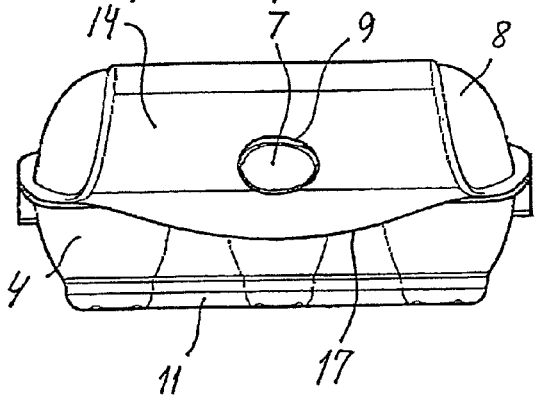
Figure 4C:
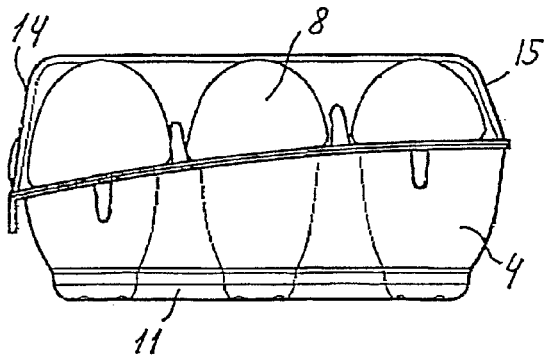
Figure 5B:
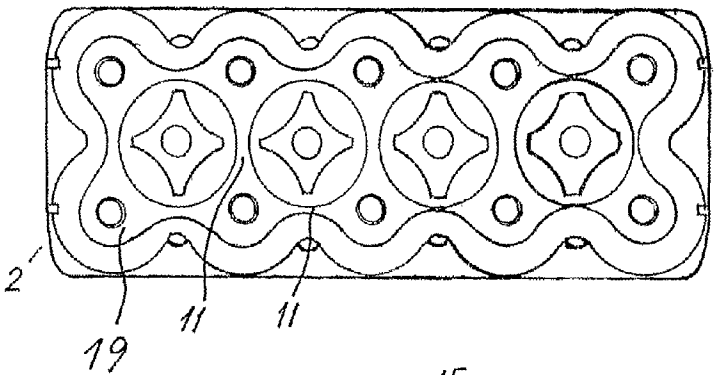
Figure 5D:
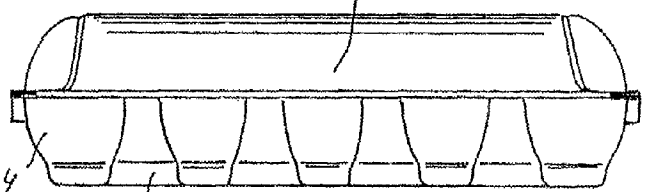
Figure 5A:
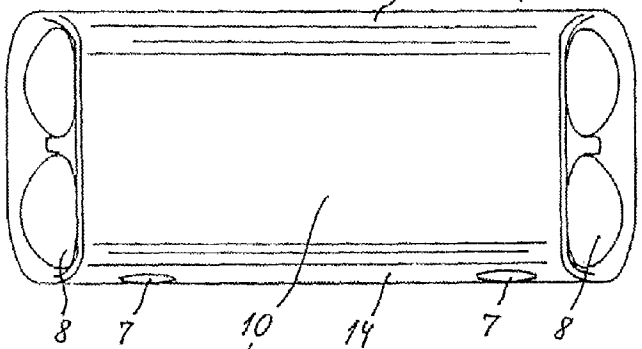
Figure 5C:
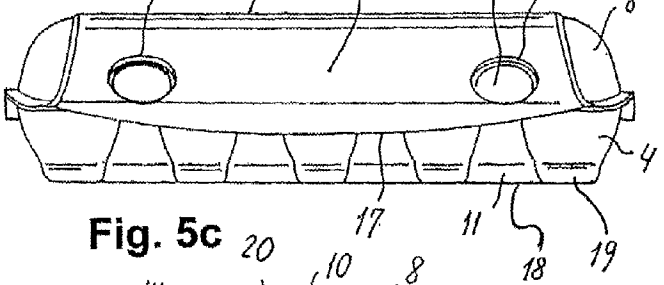
Figure 5E:
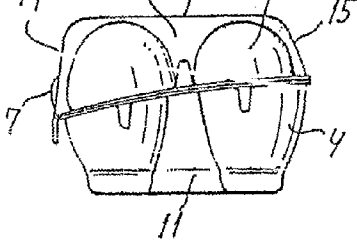

Referring now to FIG. 2, there is shown a top and bottom view of the packaging unit according to this embodiment of the invention. The egg-shaped compartment walls 8 are clearly visible on the top view, thus conveying information about the contents of the unit when this is viewed from above, i.e. when the corresponding compartment walls of the bottom part can not be seen. On the bottom view, the outer surface of the compartments 4 is shown together with a pattern of supporting ribs 11 formed between the base portions 19 of the compartments 4. Both the curved wall portions 8 of the compartments 4 and the pattern of supporting ribs 11 provide increased mechanical stability of the packaging unit. Furthermore, the supporting ribs 11 and the base portions 19 define a common, plane bottom surface for placement of the packaging unit.

Figures 6A, 6B, 6C:
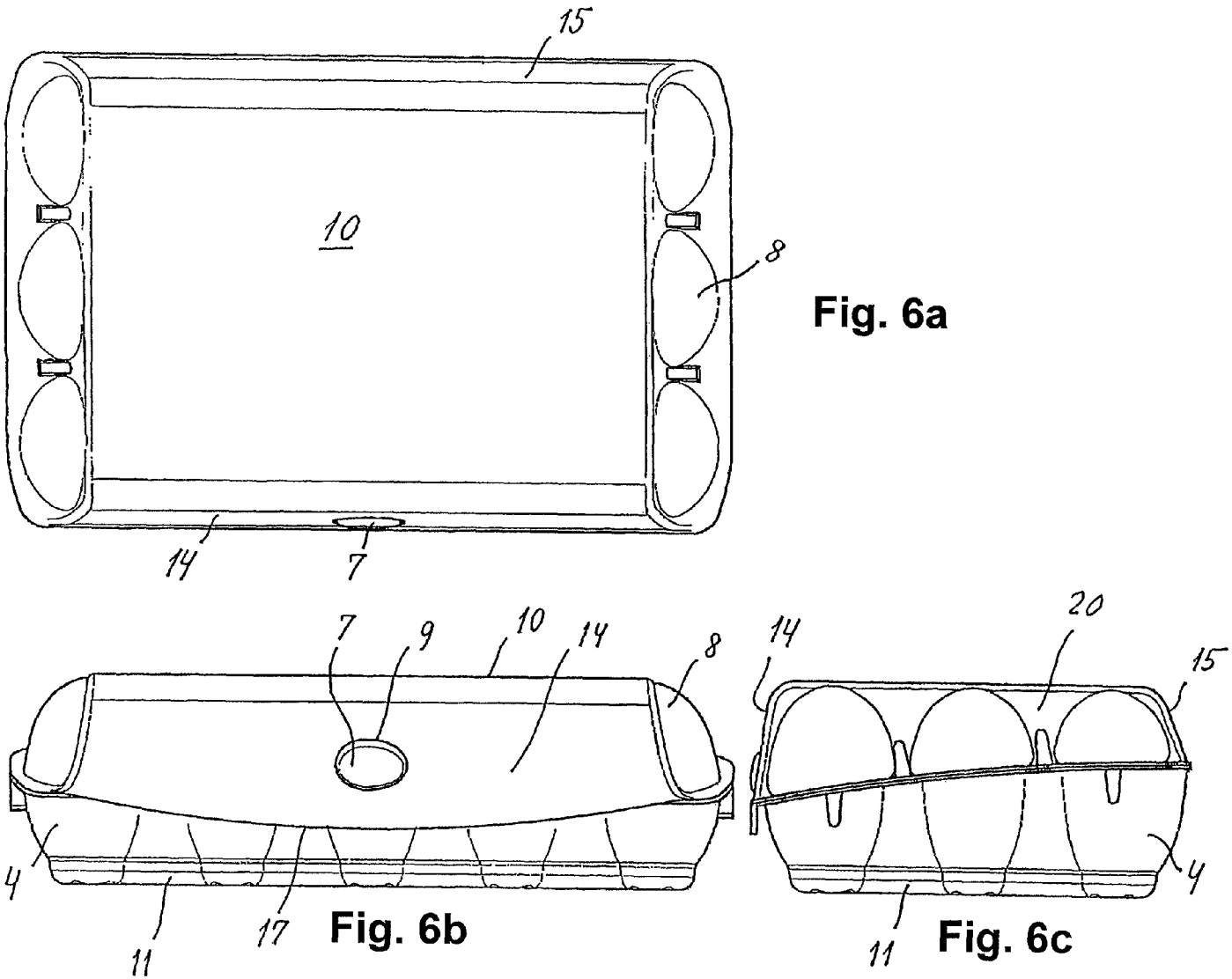
FIGS. 6*a*-6*c* show another embodiment of the packaging unit according to the invention, in which 6*a* is a top view; 6*b* is a front elevational view.
Figure 7:
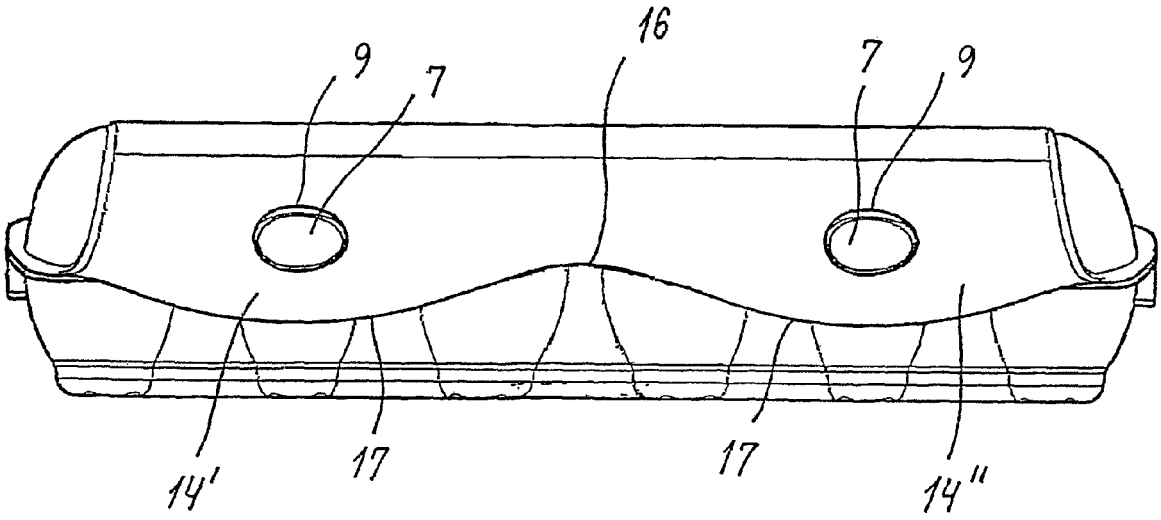
FIG. 7 shows yet another embodiment of the packaging unit as a front elevational view.

Referring to FIGS. 3*a* through 7, there are shown various embodiments of the packaging unit according to the invention. In the varying embodiments, the ovoid portions of the cover part, i.e. the curved wall portions 8, extend from end faces of the packaging unit which are either longer or shorter than the front face 14 and the rear face 15. Specifically, FIGS. 3*a*-3*d* show a packaging unit of the same basic form as shown in FIG. 1 comprising six compartments 4 for eggs. FIGS. 4*a*-4*c* show an embodiment comprising three rows each containing three compartments 4, FIGS. 5*a*-5*e* show a unit comprising two rows of five compartments 4 and FIGS. 6*a*-6*c* show a unit comprising three rows of five compartments 4. In FIG. 7, there is finally shown a side elevation view of the packaging unit shown in FIGS. 5*a*-5*e*. As indicated by reference number 16, the front face 14 of the cover part 3 can also be subdivided into two portions 14' and 14" if desired, each of these portions 14', 14" being provided with openings 9 for similarly placed protrusions 7 on the bottom part 2 of the unit. It is understood that instead of using two openings and corresponding protrusions as shown in FIGS. 6*a* through 7, it is also possible to use other numbers of openings and protrusions, as for instance only one as shown in FIGS. 1 through 4*c*.

A number of further important features of the packaging unit according to the invention are apparent from FIGS. 3*a* through 9.

Referring for instance to the two lower side elevation views of FIGS. 3*a*-3*d*, the interface 21 between the bottom part 2 and the cover part 3 inclines downwardly from the rear face 15 towards the front face 14 of the cover part. As mentioned above, the effect of this is at least twofold: it increases the area of the front face 14 of the cover part 3, thus increasing the possibility to attach for instance labels etc. to this and in the open state of the unit, it increases the part of the eggs in the front row of compartments 4, which can be seen on opening the unit. The interface 21 is shown as slightly curved from the rear towards the front face of the cover part, but other shapes could of course also be envisaged.

Furthermore, the lower portion of the front face 14 of the cover part 3 is in this embodiment extended by a flap 14''' exhibiting a downwardly curved edge portion 17. By extending the front face 14 with this flap 14''', the frontal area which can be used for graphical and/or pictorial information is increased and the presence of the flap 14''' furthermore makes the unit easier to open.

Figure 10:
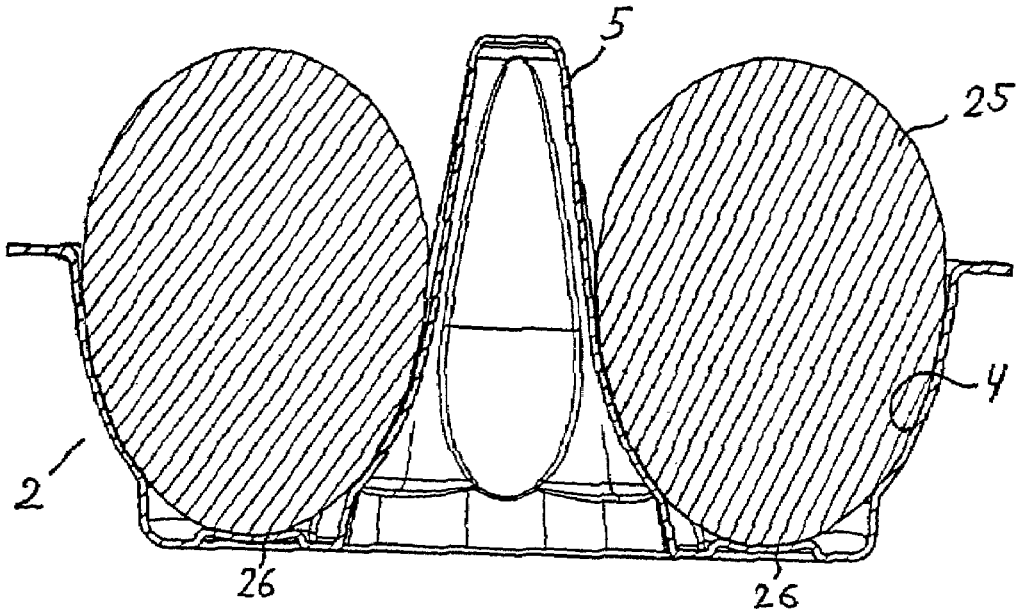
FIG. 10 shows a cross-section through the bottom part of the unit with eggs inserted in compartments hereof.

As shown in FIG. 10, the internal surface of the compartments 4 is formed to provide support for the eggs 25 housed therein. Thus, the internal surfaces of the compartments correspond to a portion of the surface of the eggs, typically at least 60% of the surface of the eggs housed within the compartments. According to the shown embodiment, the compartments 4 are also provided with support structures 26 for the lower ends of the eggs, thereby providing further support for the eggs housed within the compartments 4.

Although various embodiments of the present invention have been shown and described in the preceding parts of the detailed description, it is understood that a person skilled in the art may conceive other embodiments of the invention without departing from the scope of the invention as defined by the following claims. Specifically, it is understood that any embodiment comprising any number of rows of compartments and any number of compartments per row falls within the invention as defined by the claims.

The invention claimed is:

1. A display and distribution packaging unit for eggs or similar fragile articles, said packaging unit comprising:

a bottom part comprising nonplanar side surfaces of egg-shaped compartments which match at least partially the outer contours of the eggs contained within said unit; and a cover part comprising a top surface and substantially planar front and rear side surfaces, and planar opposing end faces, wherein the rear side surface is permanently attached to the bottom part and the front side surface comprises an opening to the unit, said cover part comprising partial ovoid portions extending outwardly from at least one of the planar end face or faces, wherein the at least one planar end face or faces wherein the at least one planar end face or faces apart from the ovoid portions completely spans the entire end face of the cover part.

2. A display and distribution packaging unit according to claim 1, where said partial ovoid portions are about one quarter of a complete ovoid.

3. A display and distribution packaging unit according to claim 1, wherein said nonplanar side surfaces of the bottom part are partially ovoid-shaped.

4. A display and distribution packaging unit according to claim 1, wherein said partial ovoid portions of the cover part continue in said corresponding egg-shaped compartments of the bottom part, the corresponding portions in the cover part and in the bottom part thereby matching a continuous portion of a surface of an egg.

5. A display and distribution packaging unit according to claim 1, wherein said partial ovoid portions located at one of the end faces or both end faces of the cover part together with the corresponding egg-shaped compartments in the bottom part correspond to a major portion of a surface of an egg.

6. A display and distribution packaging unit according to claim 5, wherein said major portion of the surface of an egg constitutes not less than approximately 60% of the total surface of an egg.

7. A display and distribution packaging unit according to claim 1, wherein a top surface of said partial ovoid portions, has a different surface structure than the remaining portions of the cover part.

8. A display and distribution packaging unit according to claim 7, wherein said surface structure of the partial ovoid portions is relatively smooth and the surface structure of the remaining surfaces of the packaging unit are relatively coarse.

9. A display and distribution packaging unit according to claim 7, wherein said surface structure of the partial ovoid portions is relatively coarse and the surface structure of the remaining surfaces of the unit is relatively smooth.

10. A display and distribution packaging unit according to claim 1, wherein said egg-shaped compartments of the bottom part have a different surface structure than the remaining portions of the bottom part.

11. A display and distribution packaging unit according to claim 10, wherein said surface structure of the compartment is relatively smooth and the surface structure of the remaining surfaces of the unit is relatively coarse.

12. A display and distribution packaging unit according to claim 10, wherein said surface structure of the compartment is relatively coarse and the surface structure of the remaining surfaces of the unit is relatively smooth.

13. A display and distribution packaging unit according to claim 1, wherein said cover part on the planar front side is provided with at least one opening for engagement with a respective protrusion provided on said bottom part.

14. A display and distribution packaging unit according to claim 13, wherein said engagement between respective protrusion and corresponding opening is a tight engagement around the complete circumference of the protrusion.

15. A display and distribution packaging unit according to claim 13, wherein the shape of the at least one opening and corresponding respective protrusion substantially correspond to a longitudinal cross-section through an egg.

16. A display and distribution packaging unit according to claim 13, wherein an outer surface of said protrusion is substantially planar.

17. A display and distribution packaging unit according to claim 13, wherein an outer surface of the protrusion is flush with said front surface of the cover part.

18. A display and distribution packaging unit according to claim 13, wherein the lower edge portion of said protrusion is flush with said front surface and where the upper edge portion of said protrusion extends outwardly relative to the front surface.

19. A display and distribution packaging unit according to claim 1, wherein said top surface and/or said front surface and/or said rear surface of the cover part is/are provided with graphical and/or pictorial information and/or embossing.

20. A display and distribution packaging unit according to claim 15, wherein an outer surface of the respective protrusion is provided with graphical and/or pictorial information and/or embossing.

21. A display and distribution packaging unit according to claim 1, wherein said bottom part and said cover part are connected to each other by means of a hinge portion extending along one edge portion of an interface between said bottom and cover parts.

22. A display and distribution packaging unit according to claim 1, wherein an interface between said cover part and said bottom part inclines downwardly from the rear side of the packaging unit to the front side, thus yielding a higher front side of the cover part than rear side of the cover part.

23. A display and distribution packaging unit according to claim 22, wherein said interface is curved.

24. A display and distribution packaging unit according to claim 1, wherein the lower edge of said front surface of the cover part is curved in a downward direction beneath an interface between said cover part and said bottom part for extension of the area of the front surface and for facilitating opening of the unit.

25. A display and distribution packaging unit according to claim 24, wherein the downward extension of the front surface covers up to the total height of the bottom part.

26. A display and distribution packaging unit according to claim 1, wherein said bottom part on an under side is provided with a pattern of supporting ribs connecting base portions of the egg-shaped compartments in the bottom part, whereby the mechanical strength of the unit is increased.

27. A display and distribution packaging unit according to claim 26, wherein said base portions and said supporting ribs define a substantially planar surface for placement of the unit.

28. A display and distribution packaging unit according to claim 26, wherein said base portions and said supporting ribs define a surface for placement of the unit, the central portions of which surface are elevated with respect to the peripheral portions hereof.

29. A display and distribution packaging unit according to claim 13, wherein the respective protrusion is provided on a flexible flap placed along one upper edge portion of the bottom part.

30. A display and distribution packaging unit according to claim 29, wherein portions of said flexible flap are formed such that they constitute a part of the walls of adjacent compartments.

31. A display and distribution packaging unit according to claim 15, wherein the size of a planar face of the respective protrusion approximately corresponds to the size of the tip of a thumb.

32. A display and distribution packaging unit according to claim 15, wherein the size of a planar face of respective protrusion is within the range (20 mm to 30 mm)×(15 mm to 20 mm).

33. A display and distribution packaging unit according to claim 1, wherein said unit is formed as one integrated unit in one material.

34. A display and distribution packaging unit according to claim 1, wherein said egg-shaped compartments of the bottom part and said partial ovoid portions of the cover part define internal surfaces in the unit, which internal surfaces correspond to a portion of a total surface of an egg.

35. A display and distribution packaging unit according to claim 34, wherein said internal surfaces in the unit correspond to at least 60% of a surface of an egg.

36. A display and distribution packaging unit according to claim 34, wherein said egg-shaped compartments are provided with support structures for ends of eggs to be placed in the compartments.

37. A display and distribution packaging unit for eggs or similar fragile articles, said packaging unit comprising:

a bottom part comprising nonplanar side surfaces of egg-shaped compartments which match at least partially the outer contours of the eggs contained within said unit; and a cover part comprising a top surface and substantially planar front and rear side surfaces, and planar opposing end faces, the planar front and rear surfaces being longer than the planar end faces, said cover part comprising partial ovoid portions extending outwardly from at least one of the planar end face or faces of said cover part, wherein the at least one planar end face or faces apart from the ovoid portions completely spans the entire end face of the cover part.

* * * * *

UNITED STATES PATENT AND TRADEMARK OFFICE

CERTIFICATE OF CORRECTION

PATENT NO. : 7,665,608 B2
APPLICATION NO. : 10/511201
DATED : February 23, 2010
INVENTOR(S) : Nick Buckley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 731 days.

Signed and Sealed this

Seventh Day of December, 2010

David J. Kappos

David J. Kappos
*Director of the United States Patent and Trademark Office*